US006962014B2

(12) United States Patent
McCabe et al.

(10) Patent No.: US 6,962,014 B2
(45) Date of Patent: Nov. 8, 2005

(54) REMOVABLE CABLE LABELING DEVICE

(76) Inventors: Suellyn A. McCabe, 512 Old Beach Rd., Santa Rosa Beach, FL (US) 32459-4466; Brian F. McCabe, 512 Old Beach Rd., Santa Rosa Beach, FL (US) 32459-4466

( * ) Notice: Subject to any disclaimer, the term of this patent is extended or adjusted under 35 U.S.C. 154(b) by 0 days.

(21) Appl. No.: 10/404,589

(22) Filed: Apr. 1, 2003

(65) Prior Publication Data

US 2004/0194360 A1 Oct. 7, 2004

(51) Int. Cl.[7] ..... G09F 3/00
(52) U.S. Cl. ..... 40/316; 40/664; 40/665; 40/668; 24/16 PB
(58) Field of Search ..... 40/316, 664, 665, 40/668, 300, 304, 633; 24/16 R, 16 PB; 292/307 A

(56) References Cited

U.S. PATENT DOCUMENTS

| | | | | | |
|---|---|---|---|---|---|
| 627,920 | A | * | 6/1899 | Gould | 40/665 |
| 1,281,288 | A | | 10/1918 | Carley | |
| 1,324,568 | A | * | 12/1919 | Shelton | 40/665 |
| 1,543,190 | A | * | 6/1925 | Sagui | 40/668 |
| 1,984,589 | A | * | 12/1934 | Ludy | 40/668 |
| 2,016,059 | A | * | 10/1935 | Stevens | 40/668 |
| 2,153,227 | A | * | 4/1939 | Allstatter | 40/668 |
| 2,554,105 | A | * | 5/1951 | Heinle | 40/662 |
| 2,831,277 | A | | 4/1958 | Strachan | |
| 2,961,785 | A | * | 11/1960 | Toepfer | 40/669 |
| 3,197,554 | A | | 7/1965 | Baker | |
| 3,785,337 | A | | 1/1974 | Flowerday | |
| 3,837,101 | A | * | 9/1974 | Young | 40/665 |
| 4,149,329 | A | * | 4/1979 | Graves | 40/668 |
| 4,234,090 | A | | 11/1980 | Barbieri | |
| 4,477,950 | A | | 10/1984 | Cisek | |
| 4,578,136 | A | | 3/1986 | Brown | |
| 4,609,208 | A | | 9/1986 | Wrobel | |
| 5,502,877 | A | | 4/1996 | Yocum | |
| 5,836,053 | A | | 11/1998 | Davignon | |
| 5,862,774 | A | | 1/1999 | Moss | |
| 5,878,520 | A | * | 3/1999 | Milbrandt et al. | 40/665 |
| 5,896,826 | A | | 4/1999 | Winer | |
| 6,311,637 | B1 | | 11/2001 | Moss | |
| 6,401,304 | B1 | * | 6/2002 | Dossett | 40/668 |
| 2004/0000082 | A1 | * | 1/2004 | Wolfgang | 40/668 |

* cited by examiner

*Primary Examiner*—Gary C. Hoge
(74) *Attorney, Agent, or Firm*—J. Wiley Horton

(57) ABSTRACT

A removable wire label. The wire label has a labeling tab attached to an elongated flexible prong. The flexible prong is wrapped around a cable and passed through a locking slot in the labeling tab. Teeth on the flexible prong engage the locking slot and prevent the flexible prong from disengaging. The locking slot has a special elliptical slot which requires the flexible prong to be rotated in order to pass through. The flexible prong's natural tendency to straighten then locks it in place. The device is easily removable, in that a user need only rotate the portion of the flexible prong sticking through the locking slot in order to release it and unwrap the flexible prong from the cable. The labeling tab allows the user to print hand-written messages on the device. As an alternative, pre-printed messages can be provided.

4 Claims, 9 Drawing Sheets

REMOVABLE CABLE LABELING DEVICE

This invention relates to the field of electrical wires and cables. More specifically, the invention comprises a labeling tab which can be applied to and removed from a wire or cable.

DESCRIPTION OF THE RELATED ART

Modern electronic equipment often requires the connection of numerous wires and cables. FIG. 1 shows the rear of electronic device 10. Numerous cables 12 are connected to electronic device 10 by connectors 14. Some of these cables are distinctive, such as large printer cables. Many, however, are not. This is particularly true for networking equipment such as routers. A router may have ten or more identical cables plugged into a series of connectors.

A particular piece of electronic equipment may periodically need to be moved, due to the need to replace a failed component, the need to relocate the user, or other reasons. When this occurs, cables 12 must generally be disconnected from electronic device 10. For many types of electronic devices, each cable needs to be placed back into the same connector. Thus, there is a need to know which cable belongs in which position. Technicians have used hand-written masking tape labels affixed to the cables to satisfy this need. Other prior art patents have disclosed labeling devices. See, as particular examples, U.S. Pat. No. 1,281,288 to Carley (1918), U.S. Pat. No. 4,415,006 to Barbieri (1983), and U.S. Pat. No. 4,578,136 to Brown (1986).

BRIEF SUMMARY OF THE PRESENT INVENTION

The present invention comprises a removable wire label. The wire label has a labeling tab attached to an elongated flexible prong. The flexible prong is wrapped around a cable and passed through a locking slot in the labeling tab. Teeth on the flexible prong engage the locking slot and prevent the flexible prong from disengaging. The locking slot has a special elliptical slot which requires the flexible prong to be rotated in order to pass through. The flexible prong's natural tendency to straighten then locks it in place.

The device is easily removable, in that a user need only rotate the portion of the flexible prong sticking through the locking slot in order to release it and unwrap the flexible prong from the cable. The labeling tab allows the user to print hand-written messages on the device. As an alternative, pre-printed messages can be provided.

REFERENCE NUMERALS IN THE DRAWINGS

Figure 1:
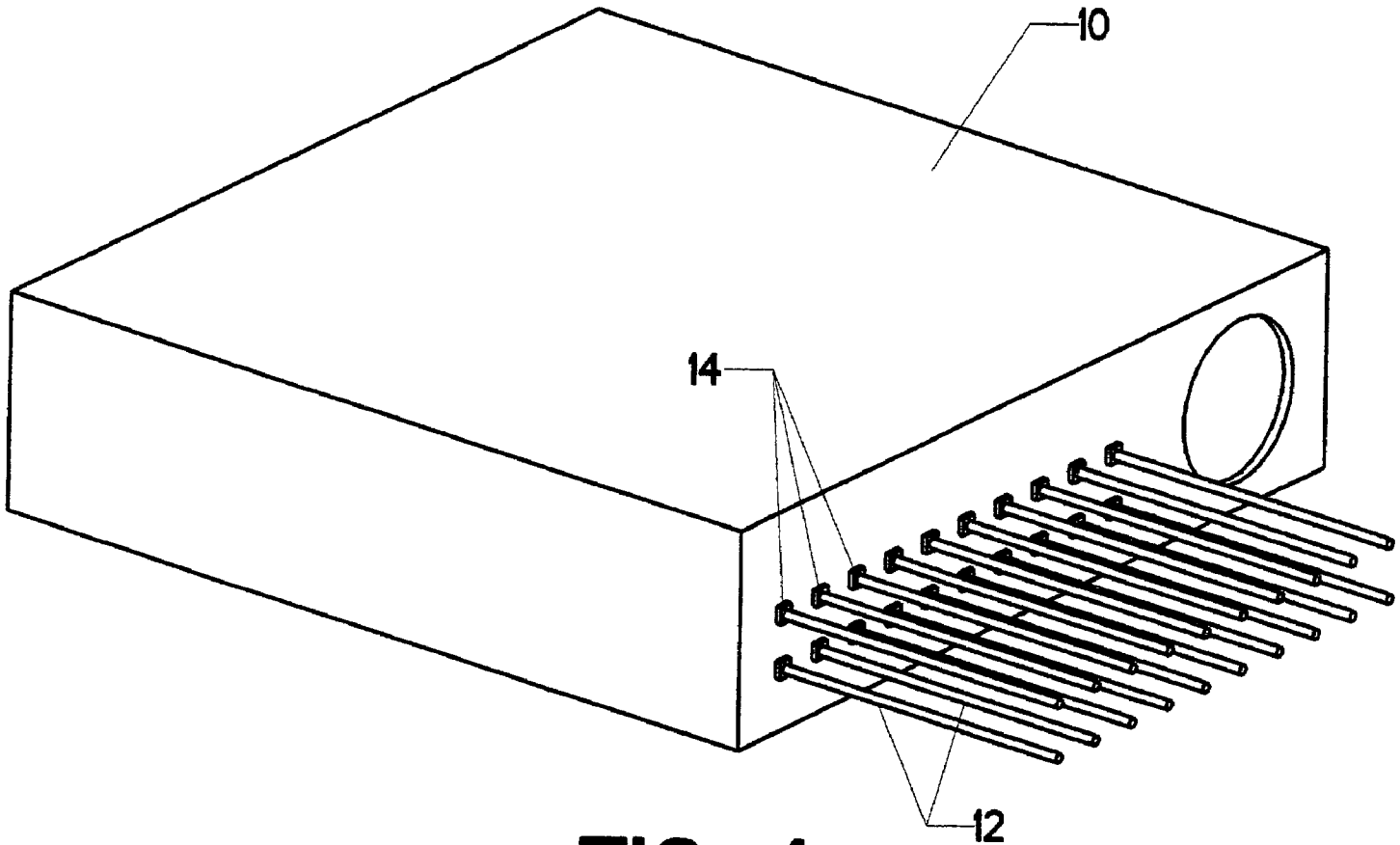
FIG. 1 (PRIOR ART)
FIG. 1 is an isometric view, showing a prior art electronic device with attached cables.

10 electronic device
12 cable
14 connector
16 wire label
18 labeling tab
20 flexible prong
22 tooth
24 taper region
26 locking slot
28 first curve
30 second curve
32 end fillet
34 tip
36 neck
38 text

DESCRIPTION OF THE INVENTION

Figure 2:
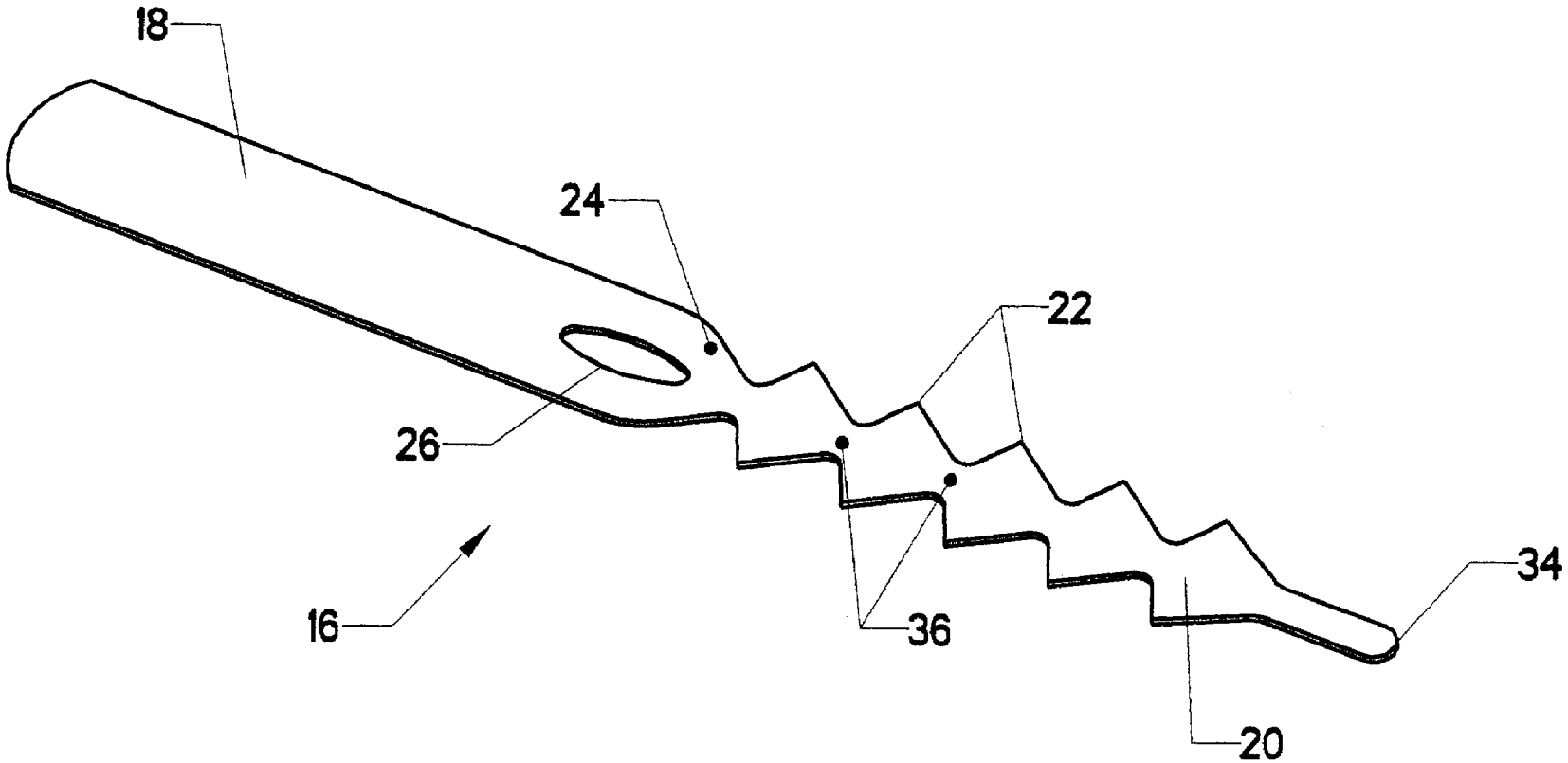
FIG. 2 is an isometric view, showing the present invention.

FIG. 2 shows wire label 16 in its natural (undeflected) state. Labeling tab 18 provides a substantially flat surface onto which text messages can be printed or written. Locking slot 26 passes completely through labeling tab 18 proximate taper region 24. Flexible prong 20 is joined to labeling tab 18 in the vicinity of taper region 24. Its free end is formed into tip 34.

Flexible prong 20 is equipped with a plurality of teeth 22. These are formed on the two long sides of flexible prong 20. The teeth are actually divided into two symmetric arrays, with one being on the first long side of flexible prong 20 and the other being on the second long side. The reader will observe that the two arrays are aligned; i.e, the tip of each tooth 22 lies exactly opposite the tip of another tooth 22 on the opposite side of flexible prong 20. This structure forms an array of necks 36 down the length of flexible prong 20, where the term "neck" is understood to mean a reduction in the cross section of flexible prong 20.

Figure 3:
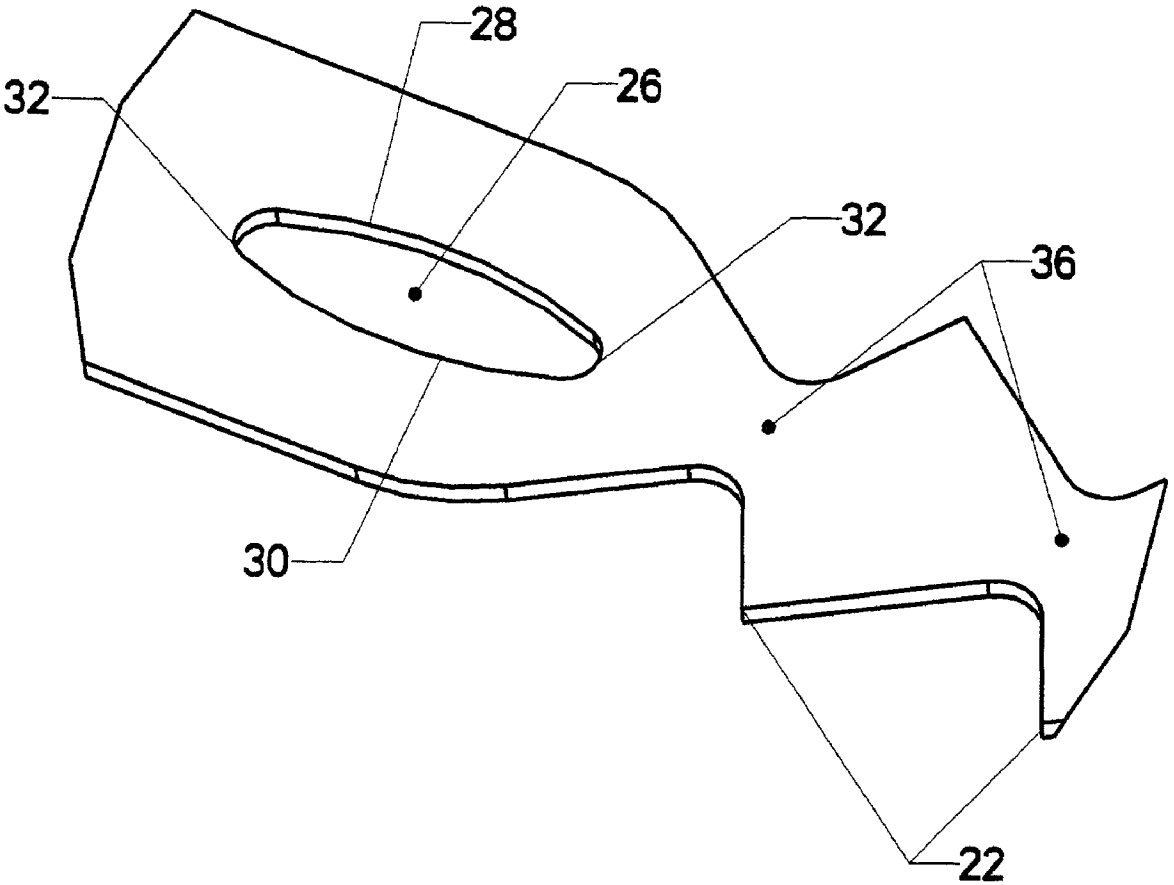
FIG. 3 is an isometric detail view, showing the locking slot and surrounding features.

FIG. 3 is a detailed view centered on taper region 24. The reader will observe that locking slot 26 generally assumes the form of an ellipse. It is in fact bounded by four distinct curves. First curve 28 bounds the upper extreme (as shown in the view) while second curve 30 bounds the lower extreme. First curve 28 and second curve 30 are joined together by a pair of end fillets 32. The shape of locking slot 26 enhances the operation of the device, as will be explained subsequently.

Figure 4:
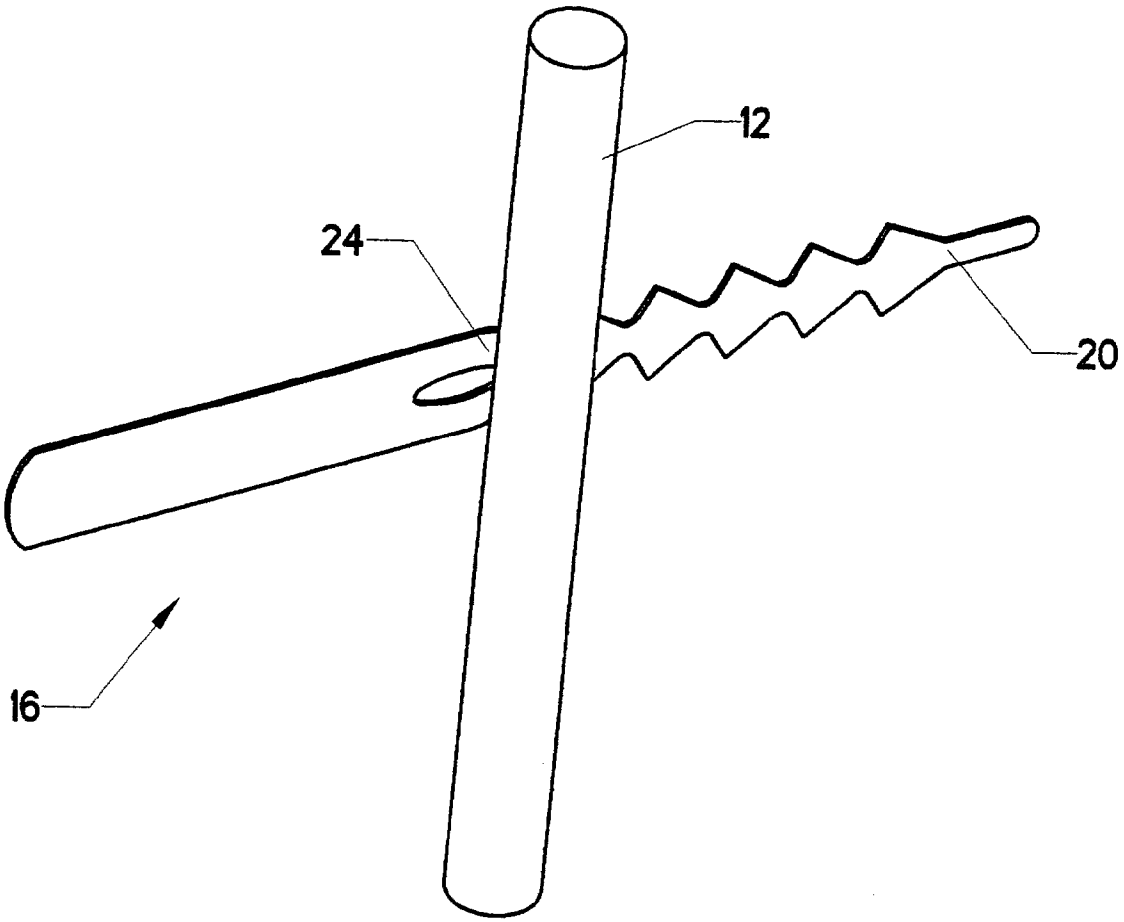
FIG. 4 is an isometric view, showing the installation of the device on a cable.
Figure 5:
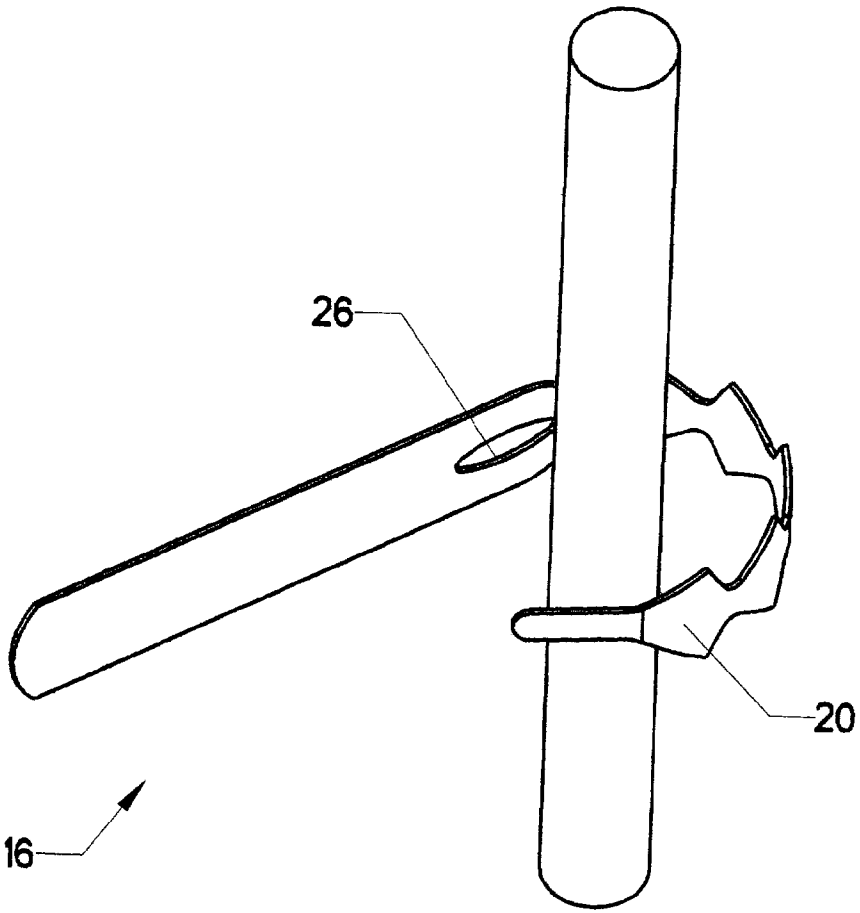
FIG. 5 is an isometric view, showing the installation of the device on a cable.
Figure 6:
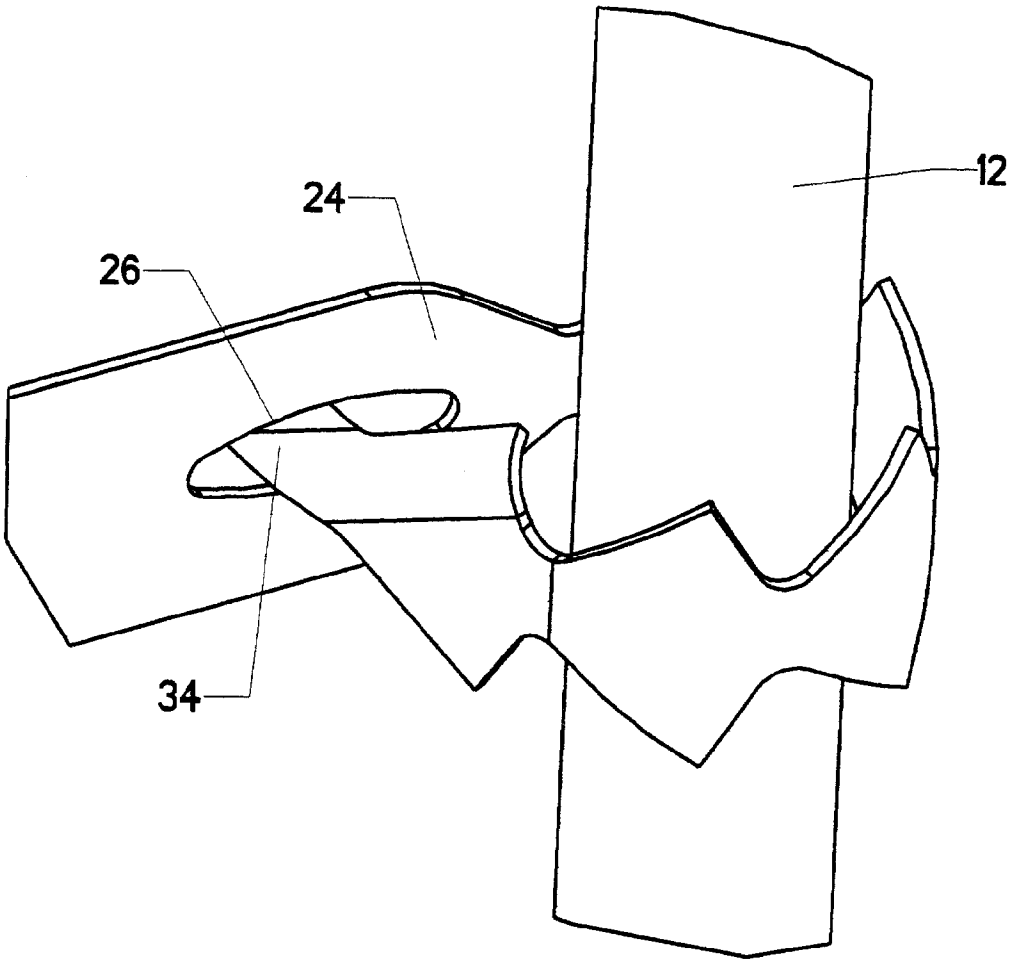
FIG. 6 is an isometric detail view, showing how the tip of the flexible prong is passed through the locking slot.
Figure 7:
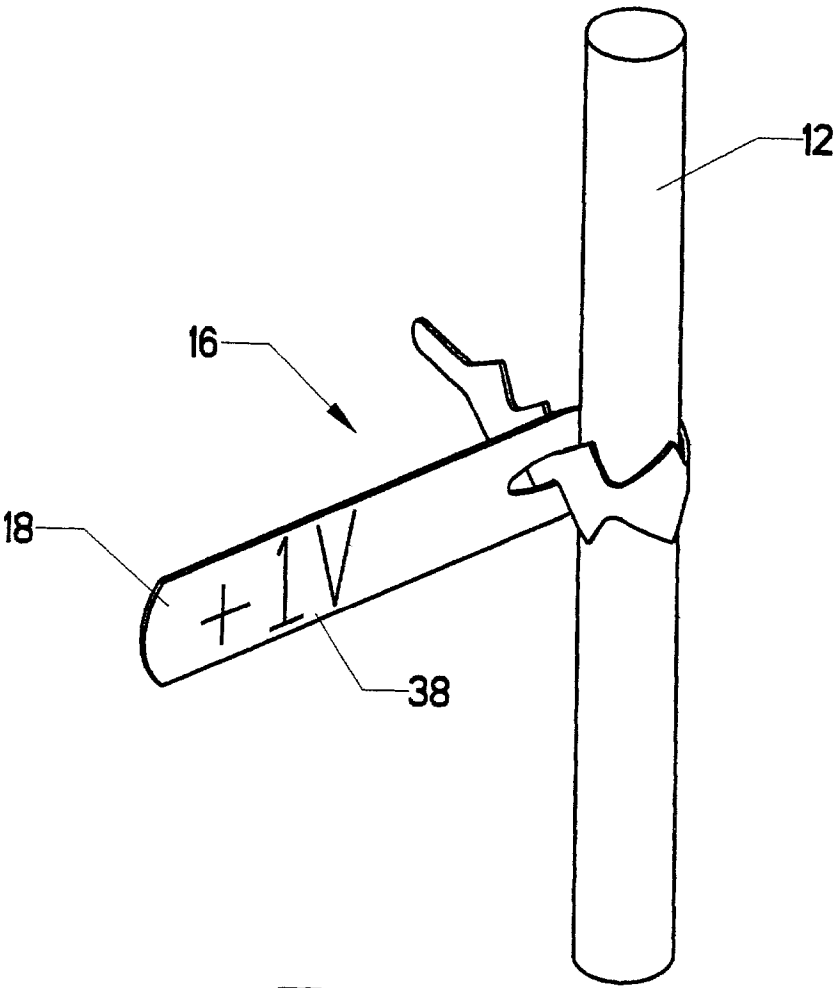
FIG. 7 is an isometric view, showing the device installed on a cable.
Figure 8:
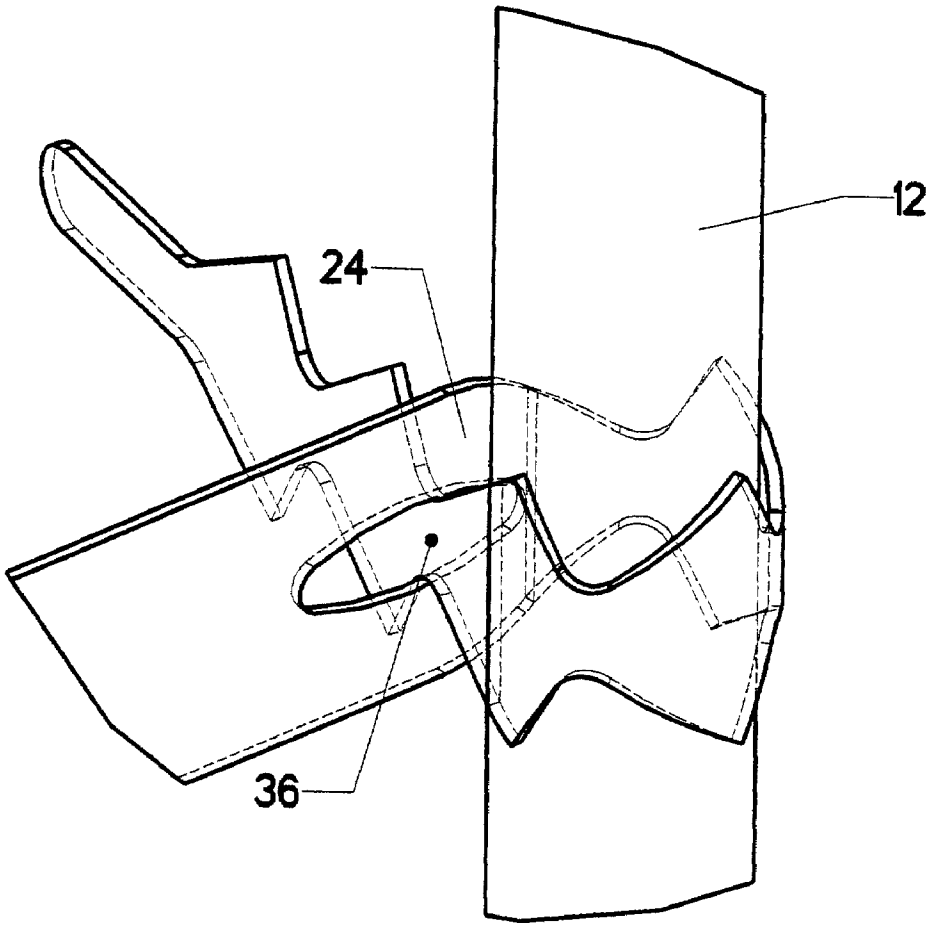
FIG. 8 is an isometric detail view, showing the flexile prong locked within the locking slot.

Beginning with FIG. 4, the installation of the device on a cable will be explained. Wire label 16 is placed next to cable 12 in a transverse orientation, with taper region 24 being closest to cable 12. Flexible prong 20 is then wrapped around the cable, as shown in FIG. 5. In order to lock the device in place, the user must push flexible prong 20 through locking slot 26. FIG. 6 is a detail view, showing the introduction of tip 34 into locking slot 26. The reader will observe that flexible prong 20 must be twisted through approximately ninety degrees in order to pass through locking slot 26. Once tip 34 is through, the user pulls an additional length of flexible prong 20 through locking slot 26 until flexible prong 20 is wrapped tightly around cable 12, FIG. 7 shows wire label 16 in position on cable 12. FIG. 8 is a detail view again showing locking slot 26. As stated previously, flexible prong 20 must be twisted to pass through locking slot 26. Wire label 16 is preferably made of resilient material which can withstand this twisting motion without plastic deformation. Thus, flexible prong 20 naturally tends to untwist itself. FIG. 8 in fact shows flexible prong 20 once the twist has resolved. The reader will observe that the spacing between first curve 28 and second curve 30 is important. The two curves are separated just enough to allow neck 36 to rest between them when flexible prong 20 is vertically oriented (in the view as shown). However, there is insufficient clearance for a pair of teeth 22 to pass back through locking slot 26. The pair of teeth 22 just through locking slot 26 will in fact bear against the back side of taper region 24 and lock the device in position.

Flexible prong 20—being made of resilient material—will tend to uncurl itself from around cable 12. This tendency pulls the pair of teeth 22 just through locking slot 26 back against the back side of taper region 24, thereby tending to further secure the device. However, it is quite simple for the user to remove wire label 16. The user need only grasp the exposed portion of flexible prong 20 and twist it. Neck 36 will tend to smoothly rotate, being guided by first curve 28 and second curve 30, until the teeth 22 can slip past the two end fillets 32. Thus, those skilled in the art will realize that the latching features are easily reversible.

Returning now to FIG. 7, the reader will observe that labeling tab 18 provides a large surface on which the user can write text messages, affix stickers, etc. The surface of labeling tab 18 is preferably made of a material which readily accepts pen and pencil markings. In the view, a user adds written text 38 on the surface of labeling tab 18. As an alternative, wire labels 16 can be provided with a variety of preprinted messages ("+12V", "GROUND", "DATA", "NETWORK", "PRINTER", etc.).

Figure 9:
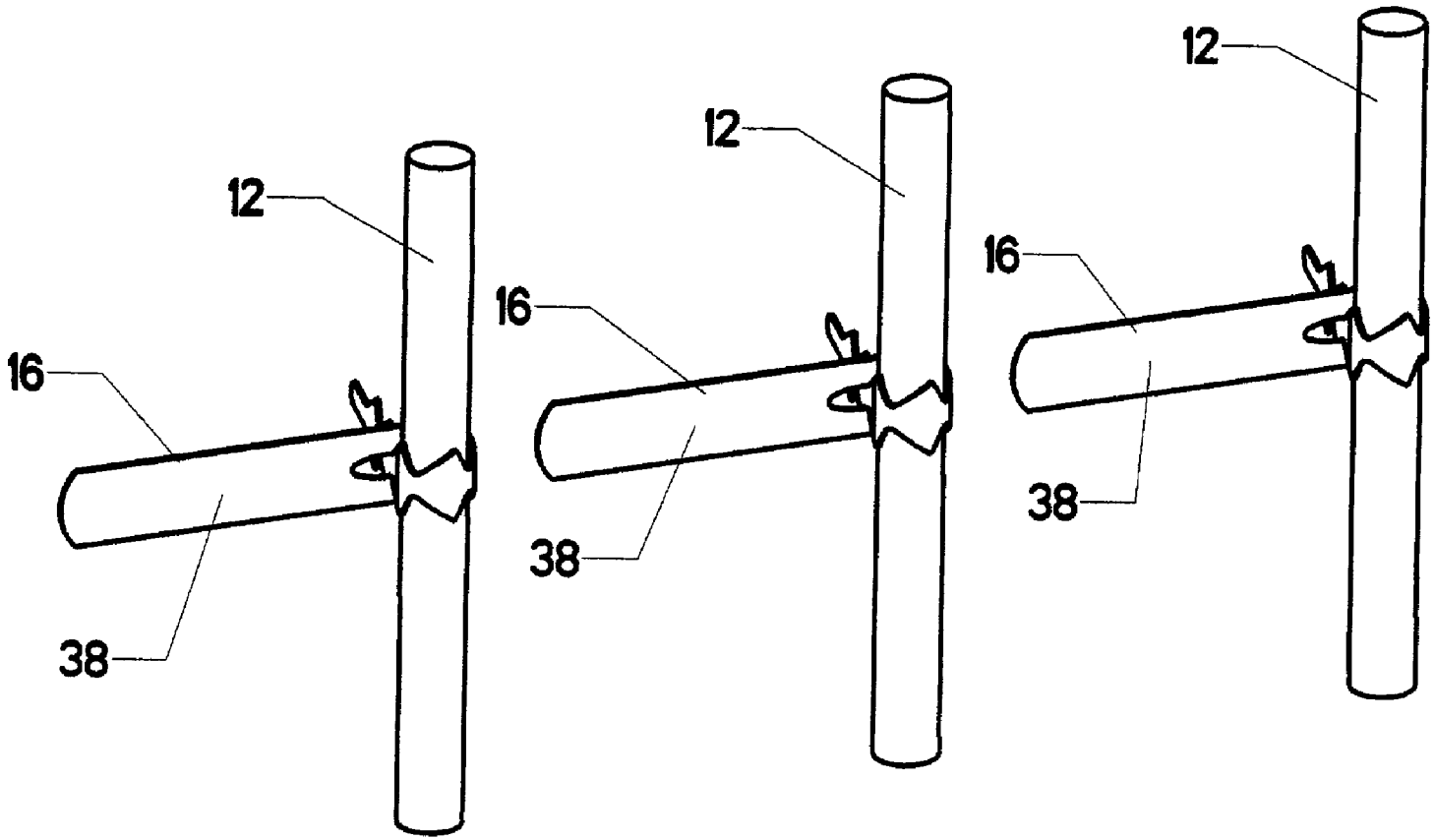
FIG. 9 is an isometric view, showing the device installed on several cables.

FIG. 9 shows the use of wire labels 16 to identify three cables 12. The devices have been shown being used with computer equipment—a common application. Those skilled in the art will realize, however, that the invention can be used in many different fields. By way of example, wire label 16 can be used to:

(1) label components of an automotive wiring harness; (2) label automotive vacuum lines; (3) label components of house wiring; and (4) label connections used in audio and video entertainment systems.

The invention is preferably formed from a single sheet of polymer. It can be injection molded or die cut from a large sheet of thin plastic. Metallic versions are also possible.

Although the preceding descriptions contain significant detail they should not be viewed as limiting the invention but rather as providing examples of the preferred embodiments of the invention. Accordingly, the scope of the invention should be determined by the following claims, rather than the examples given.

We claim:

1. A wire label allowing a user to affix a text message to a wire, comprising:

a. a labeling tab, having a first end, a second end, and a surface capable of displaying written text;

b. a locking slot passing completely through said labeling tab proximate said second end;

c. a flexible prong having a first end attached to said second end of said labeling tab, and a tip distal to said first end;

d. wherein said flexible prong has a plurality of teeth, so that said user can wrap said flexible prong around said cable, pass said tip through said locking slot, and pull said flexible prong through said locking slot until said flexible prong is wrapped tightly around said cable; and e. wherein said locking slot includes, i. a first curve bounding a first portion of said locking slot, wherein said first curve has a first end and a second end;

ii. a second curve bounding a second portion of said locking slot, wherein said second curve has a first end and a second end;

iii. a first end fillet joining said first end of said first curve to said first end of said second curve;

iv. a second end fillet joining said second end of said first curve to said second end of said second curve; and v. wherein said first curve is separated from said second curve by a distance which will allow the passage of said flexible prong when said flexible prong is in a twisted state, but not allow the passage of said teeth on said flexible prong when said flexible prong is in an untwisted state, thereby allowing said user to twist said flexible prong in order to pass said teeth through said locking slot, whereupon the natural tendency of said flexible prong to straighten will rotate said flexible prong into an orientation where said teeth bear against said labeling tab and prevent said flexible prong from passing back through said locking slot.

2. A wire label as recited in claim 1, wherein said flexible prong has a first long side, a second long side opposite said first long side, and wherein said plurality of teeth is divided into a first array of teeth along said first long side and a second array of teeth aligned with said first array along said second long side in order to form an array of necks along said flexible prong.

3. A wire label as recited in claim 1, wherein preprinted text is provided on said labeling tab.

4. A wire label as recited in claim 2, wherein preprinted text is provided on said labeling tab.

* * * * *

UNITED STATES PATENT AND TRADEMARK OFFICE

CERTIFICATE OF CORRECTION

PATENT NO. : 6,962,014 B2
DATED : November 8, 2005
INVENTOR(S) : SuEllyn A. McCabe It is certified that error appears in the above-identified patent and that said Letters Patent is hereby corrected as shown below:

Title page,
Item [75], Inventor, should read -- SuEllyn A. McCabe --.

Signed and Sealed this

Twenty-fourth Day of January, 2006

JON W. DUDAS
*Director of the United States Patent and Trademark Office*